United States Patent [19]

Oshima

[11] Patent Number: 4,713,914

[45] Date of Patent: Dec. 22, 1987

[54] INTERNAL GRINDING METHOD

[75] Inventor: Jinichiro Oshima, Narashino, Japan

[73] Assignee: Seiko Seiki Kabushiki Kaisha, Chiba, Japan

[21] Appl. No.: 823,207

[22] Filed: Jan. 28, 1986

[30] Foreign Application Priority Data

Jan. 29, 1985 [JP] Japan ..... 60-15001

[51] Int. Cl.[4] ..... B24B 5/00; B24B 17/00

[52] U.S. Cl. ..... 51/281 P; 51/5 D; 51/165.77

[58] Field of Search ..... 51/5 D, 48 R, 50 R, 51/103 R, 103 C, 105 R, 165.77, 165.87, 165.93, 281 P, 325

[56] References Cited

U.S. PATENT DOCUMENTS 3,774,349 11/1973 Uhtenwoldt et al. ..... 51/165.93 X 3,924,355 12/1975 Tatsumi et al. ..... 51/165.77 X 4,059,927 11/1977 Robillard ..... 51/165.87 X 4,096,667 6/1978 Uhtenwoldt et al. ..... 51/105 R X 4,151,684 5/1979 Wada et al. ..... 51/5 D

*Primary Examiner*—Robert P. Olszewski

*Attorney, Agent, or Firm*—Bruce L. Adams; Van C. Wilks

[57] ABSTRACT

In a method of internal grinding with a grinding wheel composed of cubic boron nitride, in order to maintain the processing accuracy of workpieces in each grinding cycle after the completion of dressing, the grinding wheel undergoes a corrective retracting movement from the roughly ground surface of a workpiece at the larger amount than the normal retraction amount in the predetermined time or in a time for grinding the predetermined pieces of the workpiece just after completion of dressing.

10 Claims, 9 Drawing Figures

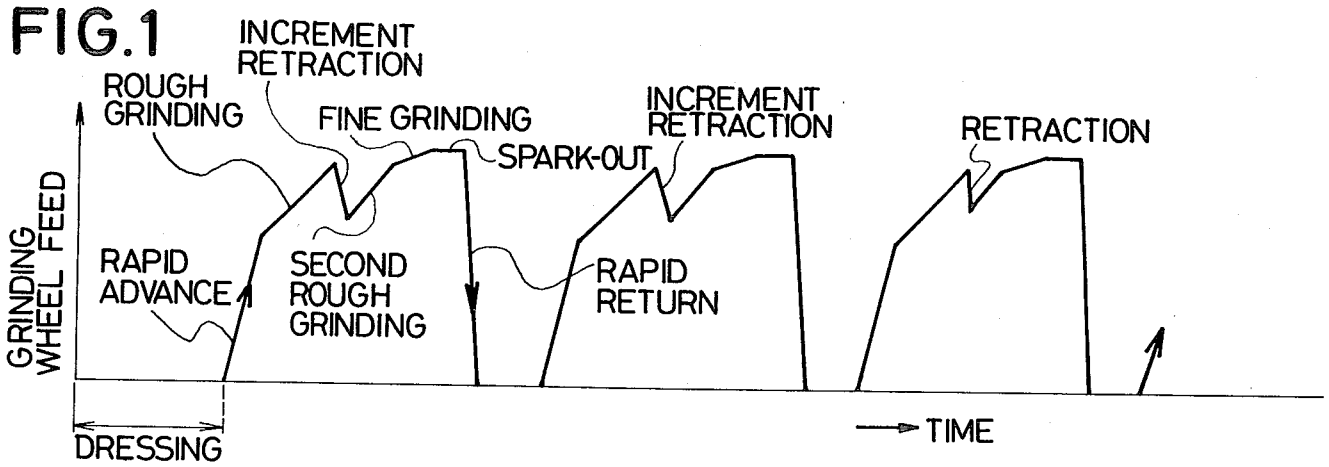
FIG. 1
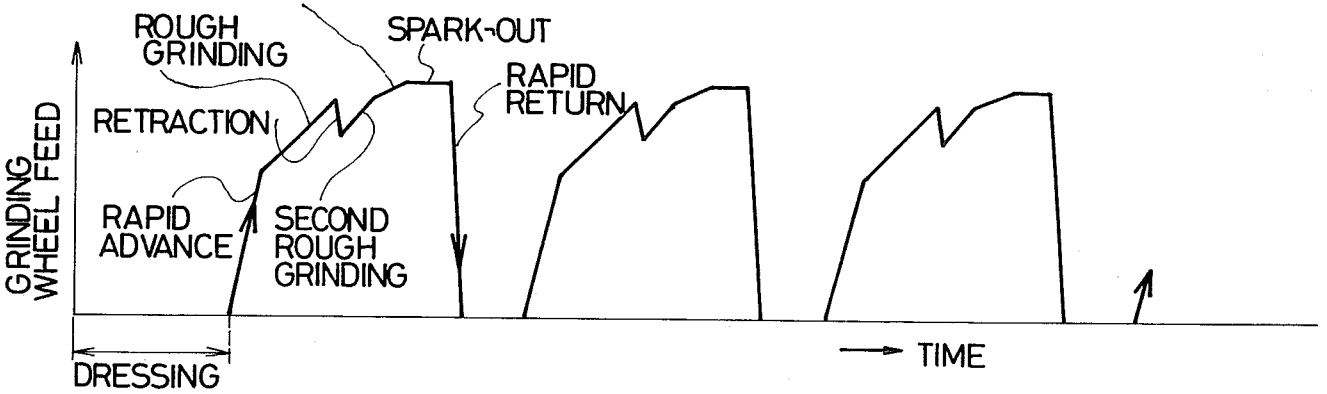
PRIOR ART FIG. 2

INTERNAL GRINDING METHOD

BACKGROUND OF THE INVENTION

This invention relates to a method which executes a internal grinding of a workpiece by use of a grinding wheel, which is composed of abrasive grains of ultra hard material such as a cubic boron nitride (CBN).

Conventionally, in a case of executing the internal grinding, by use of the grinding wheel such as CBN grinding wheel (hereinafter called so) which is composed of the abrasive grains of the ultra hard material such as a cubic boron nitride and etc., there is a problem that just after the completion of dressing, the sharpness of the grinding wheel becomes dull and thereby several and/or several tens of workpieces are ground through the internal grinding in a manner that the ground hole is shaped in progressively narrowed toward the end, namely the cylindricity becomes poor. Thus, conventionally, the workpeice just after the dressing is inspected and selected by the man power. Otherwise, several and/or several tens of the workpieces are abolished just after the dressing, which is called a dummy work.

SUMMARY OF THE INVENTION

As set forth above, there are problems of the difficulty of no-labor driving in the selection process and of occurrence of the loss of raw material and the loss of time in case of using a dummy workpiece. Accordingly, this invention is intended to settle the above mentioned drawbacks and to provide a method for accurately processing the workpiece even if the CBN grinding wheel becomes dull just after the dressing.

This invention is intended to settle the problems and is characterized in that it executes the dressing of CBN grinding wheel by use of a diamond dresser and after completion of dressing the grinding wheel, it executes the grinding according to the infeeding pattern of the grinding cycle in which a retraction amount of the grinding wheel is larger than the normal retraction amount in the predetermined time and/or in a time for grinding the predetermined number of the workpieces and thereafter, it executes the grinding according to the infeeding pattern of the above mentioned normal retraction amount so as to accurately process the workpiece.

According to this invention, just after the completion of the dressing, the sharpness of the grinding wheel becomes dull and the degree that the ground hole is narrowed toward the end becomes larger than the normal, but by grinding at the retraction amount larger than the normal amount, the hole is repeatedly ground from its end residual stock-removal such that the workpiece of good cylindricity can be obtained just after the dressing and in addition, as the sharpness of the grinding wheel becomes improved after several and/or several tens of the workpieces are ground, it is possible that the workpiece can be processed in more shortened time by reverting to the normal retraction amount.

BRIEF DESCRIPTION OF THE DRAWINGS

FIG. 1 and FIG. 2 illustrate an infeeding pattern of the grinding wheel respectively, FIG. 1 of which shows an embodiment of this invention and FIG. 2 of which shows a prior art.

DETAILED DESCRIPTION OF THE INVENTION

Hereinafter, the embodiments of this invention will be explained in conjunction with the drawings. FIG. 2 illustrates an embodiment of conventional infeeding pattern in which the grinding wheel executes a rapid advance, a rough or coarse grinding, a retraction, a second rough grinding, a fine grinding, a spark-out and a rapid return successively and repeats in turn at every workpiece. FIG. 1 illustrates an embodiment of grinding in accordance with the method of this invention wherein, the grinding wheel operates to grind two workpieces just after the completion of the repeated dressing at the infeeding pattern of a grinding cycle during which the retraction amount of the grinding wheel is larger than the normal retraction amount and moreover, the grinding wheel executes to grind the third and further workpieces at the infeeding pattern of the normal retraction amount. Namely, just after completion of the dressing, it executes a rapid advance, a rough grinding, an increased retraction, a second rough grinding, a fine grinding, a spark-out and a rapid return successively and the second workpiece is ground at the same infeeding pattern of the grinding cycle and the third workpeice is ground at the infeeding pattern of the normal retraction amount.

Figure 3A:
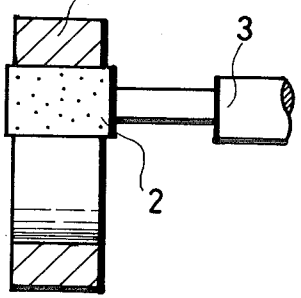
FIGS. 3A, 3B and 3C illustrate respectively a relation between the workpiece and the grinding wheel in a case that the sharpness thereof is normal.
Figure 3B:
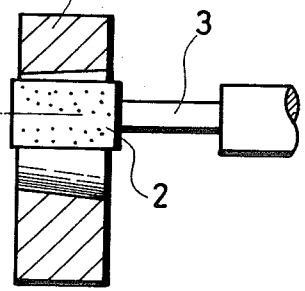
Figure 3C:
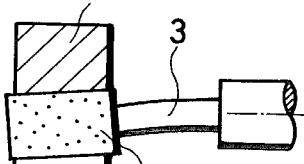

More detailedly speaking, FIGS. 3A–3C illustrate a relation between the workpiece 1 and the grinding wheel or tool 2 in a case that the sharpness or the abrading capacity of the grinding wheel is normal. FIG. 3A illustrates a state that a rough grinding is over and FIG. 3B illustrates a state that the grinding wheel executes a retraction and FIG. 3C illustrates a state that it executes a spark-out.

When the grinder shaft 3 is comparatively poor in rigidity as in the internal grinding machine, as illustrated in FIG. 3A, the bending of the grinder shaft 3 will occur under the grinding process due to the grinding resistance, therefore, if the grinding is completed at this stage, the cylindricity of the ground surface of the work piece is deteriorated. Accordingly, the retraction is needed in order to eliminate this drawback.

Figure 4D:
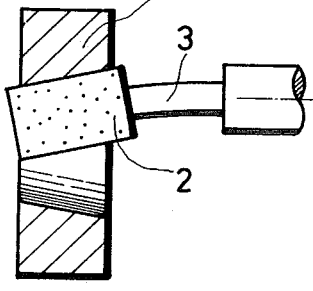
FIGS. 4D, 4E and 4F illustrate a relation between the workpeice and the grinding wheel in a case that the sharpness thereof is not sufficient.
Figure 4E:
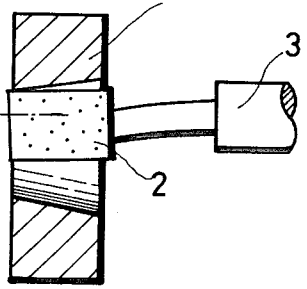
Figure 4F:
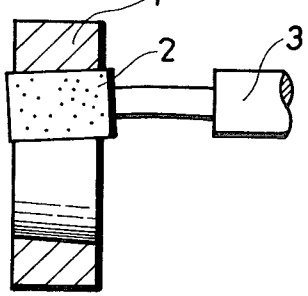
Figure 5:
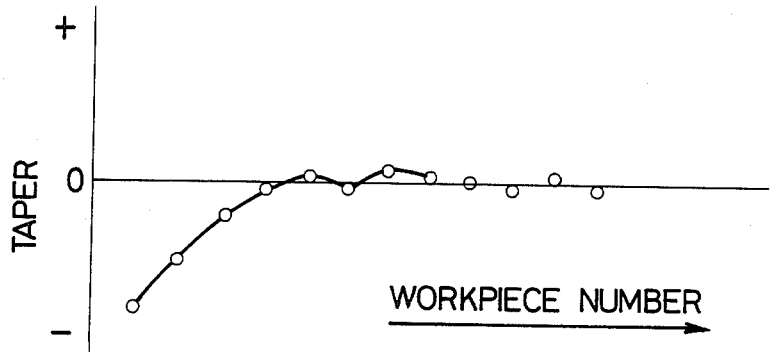
FIG. 5 is a result of processing in accordance with the conventional method.

In FIG. 3B, the grinding wheel executes a retraction movement from the roughly ground surface through the relatively small correction distance of the amount R so as to correct the bending of the grinder shaft and further, it executes a second rough grinding such that the hole is progressively ground from the residual stock removable in the end of the hole of the workpiece and eventually, it executes a fine grinding and a spark-out and executes a finishing as shown in FIG. 3C. Such finishing method is a popular method that is used in order to shorten the processing time and to attain high accurate cylindricity. However the sharpness of the CBN grinding wheel becomes dull, just after the completion of the dressing, because the dresser smoothes the surface of the abrasive grain so as to round the edge of the abrasive grains. FIGS. 4D–4F illustrate a relation between the workpiece and the grinding wheel when the grinding wheel executes a processing just after the completion of the dressing. FIG. 4D illustrates a state that a rough grinding is completed and it shows that the bending of the grinder shaft 3 is more increased due to the dull sharpness of the grinding wheel in comparison with the state shown in FIG. 3A and the cylindricity of the workpiece is deteriorated. Next, if the grinding wheel executes a retraction by the same small amount R, the workpiece 1 do not leave the grinding wheel 2, as shown in FIG. 4E, because the taper degree is larger than in the normal processing. Thus, the grinder shaft 3 maintains its bent state. Further, if the grinding wheel executes a second rough grinding and a spark-out as shown in FIG. 4F, the grinder shaft 3 maintains its bent state such that the hole maintains its tapered state. FIG. 5 illustrates a result of grinding owing to the conventional method. In the drawing, the mark "-" means that the diameter of the hole is smaller in the back portion thereof. It is clear that the n pieces of the workpieces (being three in the drawing) are smaller in its diameter of the back portion of the hole due to the dullness of the grinding wheel, but the fourth and further ones are normalized.

As a means for solving this fault, the grinding wheel executes to grind workpieces at the larger retraction amount than the normal amount, namely, the grinding wheel undergoes the retracting movement through a relatively large correction distance just after the dressing such that the grinding wheel is caused to perfectly leave the workpiece so as not to exert the bending of the grinder shaft 3 and further, the grinding wheel executes a second rough grinding, a fine grinding and a spark-out successively, thereby the cylindricity thereof is extremely improved. Furthermore, if it executes to repeatedly grind several and/or several tens of the workpieces which is differ in response to the workpeice material and/or the kind of the grinding wheel after the dressing thereof, the sharpness or the abrading capacity of the grinding wheel is restored or recovered again, therefore even though the retraction amount is changed to the normal small amount the accuracy of the cylindricity can be maintained. Abovementioned explanation of the drawing describes an exemplified embodiment that the length of the hole is shorter than the length of the grinding wheel.

Moreover, it is very effective to the socalled reciprocation grinding that carry out the reciprocation of the grinding wheel in a case that the length of the hole is comparatively longer than the diameter of the hole and the length of the grinding wheel is comparatively shorter than the length of the hole.

As set forth above, this invention has superior advantages that it is possible to carry out the accurate and stable grinding just after the dressing and of omitting the accuracy inspection and/or the selection of the workpiece just after the dressing which is carried out by the man power in the past time and to utilize the workpeice which is abolished in the past time as a dummy work, by employing a method of grinding a workpiece at the more retraction amount than the normal amount just after the completion of the dressing and thereafter grinding workpieces at the normally reverted retraction amount after the predetermined pieces of the workpiece are ground.

What is claimed is:

1. A grinding method for grinding a workpiece in repeated grinding cycles during which a grinding tool undergoes advancing movement relative to the workpiece to grind a surface of a workpiece and relative retracting movement from the ground surface of the workpiece through a correction distance to correctively grind the ground surface, the method comprising the steps of: dressing a grinding tool; repeatedly carrying out one grinding cycle during which the dressed grinding tool undergoes relative retracting movement through a relatively large correction distance until the dressed grinding tool recovers a certain abrading capacity during the course of the grinding cycles; and thereafter repeatedly carrying out another grinding cycle during which the recovered grinding tool undergoes relative retracting movement through a relatively small correction distance.

2. A grinding method according to claim 1; wherein the grinding tool effects internal grinding of the workpiece.

3. A grinding method according to claim 1; wherein the grinding tool is made of ultra hard material.

4. A grinding method according to claim 3; wherein the grinding tool is made of cubic boron nitride.

5. A grinding method according to claim 1; wherein the grinding tool comprises a grinding wheel.

6. A grinding method according to claim 1; wherein the grinding tool sequentially undergoes first advancing movement to coarsely grind the surface of the workpiece, momentary retracting movement to correctively grind the coarsely ground surface, and second advancing movement to finely grind the corrected surface during one grinding cycle.

7. A grinding method according to claim 1; wherein said one grinding cycle is repeated to reach a predetermined repetition number.

8. A grinding method according to claim 1; wherein said one grinding cycle is repeated during a predetermined time interval.

9. A grinding method according to claim 1; wherein said another grinding cycle is repeated until the grinding tool loses the certain abrading capacity.

10. A grinding method according to claim 9; wherein the step of dressing the grinding tool is carried out after the grinding tool loses the certain abrading capacity.

* * * * *